United States Patent [19]

Kuramoto

[11] Patent Number: 4,611,547

[45] Date of Patent: Sep. 16, 1986

[54] UPPER THREAD TENSION DEVICE OF A SEWING MACHINE

[75] Inventor: Hidechika Kuramoto, Tokyo, Japan

[73] Assignee: Janome Sewing Machine Co., Ltd., Kyobashi, Japan

[21] Appl. No.: 745,003

[22] Filed: Jun. 13, 1985

[30] Foreign Application Priority Data

Jun. 13, 1984 [JP] Japan ..... 59-86694[U]
Jun. 13, 1984 [JP] Japan ..... 59-86695[U]

[51] Int. Cl.[4] ..... D05B 47/02
[52] U.S. Cl. ..... 112/254
[58] Field of Search ..... 112/254, 255; 242/150 R

[56] References Cited

U.S. PATENT DOCUMENTS

| | | | |
|---|---|---|---|
| 2,609,772 | 9/1952 | Casas-Robert | 112/254 |
| 2,993,456 | 7/1961 | Herbst | 112/254 |
| 3,347,195 | 10/1967 | Gegauf | 112/254 |
| 3,738,298 | 6/1973 | Albrecht | 112/254 |
| 4,246,857 | 1/1981 | Gonnai | 112/254 |

FOREIGN PATENT DOCUMENTS

| | | | |
|---|---|---|---|
| 1207419 | 9/1970 | United Kingdom | 112/254 |

*Primary Examiner*—Werner H. Schroeder
*Assistant Examiner*—Andrew M. Falik
*Attorney, Agent, or Firm*—Michael J. Striker

[57] ABSTRACT

A thread tension device of a sewing machine having a fabric presser bar lifting lever, comprises a mount plate fixedly arranged in the sewing machine, a support shaft having one end secured to said mount plate, a pair of first and second thread tensioning disks coaxially mounted on the support shaft and having concentrically arranged curved thread clamping faces which are pressed against each other to clamp therebetween an upper thread of the sewing machine, a spring operated to adjustably press the disks against the mount plate, a thread tension adjusting member operated to increase or decrease an elastic force of the spring, an actuating plate and a transmission rod having one end connected to the actuating plate and the other end operatively connected to the fabric presser bar lifting lever. The transmission rod is operated to actuate the actuating plate to thereby turn the first thread tensioning disk axially of the support shaft on a fulcrum provided by one end portion of the curved thread clamping face of the first thread tensioning disk, so as to move an opposite end portion of the thread clamping face of the first thread tensioning disk away from the second thread tensioning disk.

2 Claims, 12 Drawing Figures

UPPER THREAD TENSION DEVICE OF A SEWING MACHINE

BACKGROUND OF THE INVENTION

The present invention relates to a sewing machine in general, and more particularly to a thread tension device of a sewing machine which is operated in association with a fabric presser lifting lever to be ready for positively receiving a thread to be adjustably tensioned for sewing a fabric.

The upper thread tension device of a sewing machine generally includes a pair of tension disks which are adjustably pressed against each other by a thread tension spring to clamp an upper or needle thread therebetween with an adjustable pressure to give the thread a desirable tension in dependence upon the kind of fabrics to be stitched, the type of threads to be used and/or the stitches to be selected. Each thread tension disc is usually finished with precision grinding on the thread holding face of the disc. When the tension device does not hold the thread and the thread tension discs are not given pressure, they are closely in contact with each other. Therefore, the thread must be held with an operator's both hands under tension for setting the thread between the discs. Contemporary sewing machines have the thread tension discs housed within a machine frame. With such a structure, the setting of the upper thread will be quite difficult. When the thread is loosened and the thread tension disc is separated from a thread tension base plate, the thread will drop into a space between the base plate and the tension disc.

SUMMARY OF THE INVENTION

It is an object of the present invention to eliminate the defects and disadvantages of the prior art.

It is a further object of the invention to provide a thread tension device which is operated to enable a user of the sewing machine to easily insert the upper thread into a prescribed place of the thread tension device.

It is yet a further object of the invention to provide a thread tension device which is simple in structure and positive in operation and which can be produced at a low cost.

These and other object are attained by a thread tension device including a pair of threaded tensioning disks, one of which is effectively operated with respect to the other which is kept fixed to thereby provide a clearance between the two thread tensioning disks for inserting therein the upper thread to be tensioned, the thread tensioning disks being coaxially mounted on a support shaft of the sewing machine and having cocentrically extended curved thread clamping faces formed on sides thereof to be pressed against each other to clamp therebetween an upper thread of the sewing machine; spring means which are progressively operated to adjustably press the disks against a mount plate of the sewing machine; thread tension adjusting means adjustably operated to progressively increase or decrease an elastic force of the spring means to thereby adjust a thread clamping pressure between the thread clamping faces of the thread tensioning disks; actuating means provided between the spring means and the thread tensioning disks to press one of the thread tensioning disks against the mount plate and press the other of the thread tensioning disks against said and thread tensioning disk; and transmission means including a transmission rod having one end operatively connected to the actuating means and the other end operatively connected to a fabric presser bar lifting lever of the sewing machine, the transmission rod being operated in association with the fabric presser bar lifting lever so that when the latter is operated in one way the actuating means is actuated to turn said other thread tensioning disk axially of the support shaft on a fulcrum provided by one end portion of said curved thread clamping face of said other thread tensioning disk, so as to move a diametrically opposite end portion of said thread clamping face of said other thread tensioning disk away from said one thread tensioning disk.

DETAILED DESCRIPTION OF PREFERRED EMBODIMENTS

Figure 1:
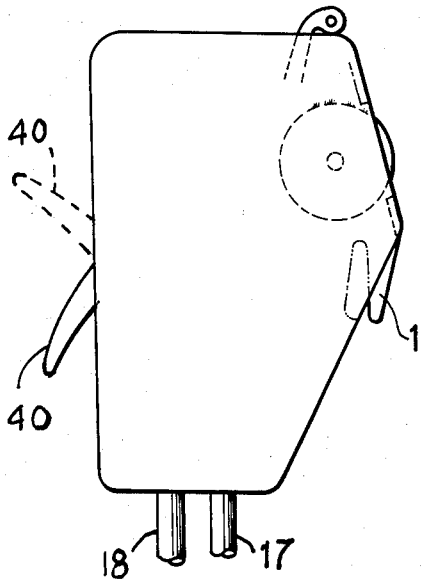
FIG. 1 is a side view of thread tension device attached to the sewing machine, in accordance with the invention.
Figure 2:
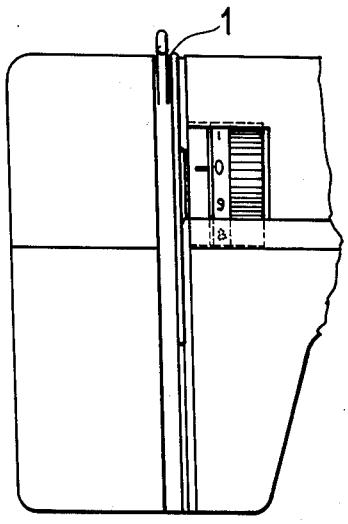
FIG. 2 is a front elevational view of the invention shown in FIG. 1.

In reference to FIGS. 1 and 2, a sewing machine has a bracket arm 15, in which a thread take-up lever 16, a needle bar 17 and a fabric presser bar are mounted. The fabric presser bar 18 has a lower end, (not shown), to which a conventional fabric presser foot is connected and is operatively connected to a fabric presser bar lifting lever 40 shown in two operative positions.

The bracket arm 15 has a mount or base plate 1 secured thereto. The mount or base plate 1 serves to guide a thread, and is fixed with a thread tension shaft 2 by a disc screw 3. On the thread tension shaft 2, there are respectively movably mounted thread tensioning discs 4 and 5 for holding the thread therebetween, a disc actuating plate 6 for loosening the thread, a thread tension spring 7 for pressing the thread tension discs against each other, an adjusting threaded screw or member 8 for respectively increasing or decreasing a compression amount of the thread tension spring, a thread tension dial 9 for varying the tension of the thread, which dial is an external operating part, and a dial spring 10 for providing torque to said dial.

Figure 3:
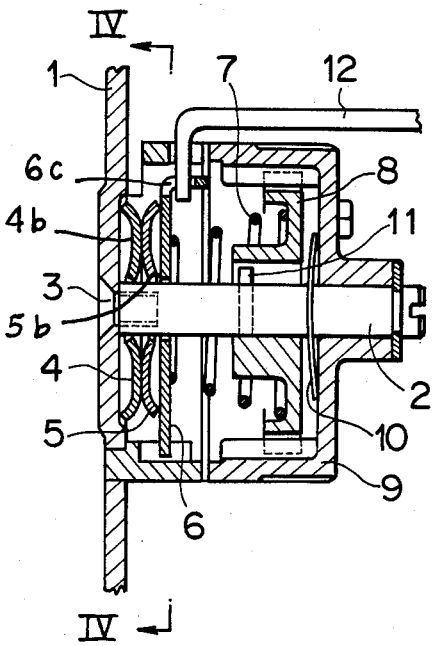
FIG. 3 is a vertical cross-sectional view of the thread tension device of the invention.
Figure 4:
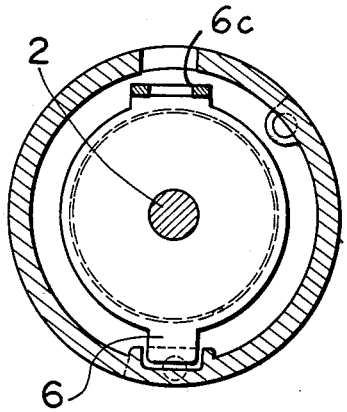
FIG. 4 is a sectional view taken along the line IV—IV of FIG. 3.
Figure 5:
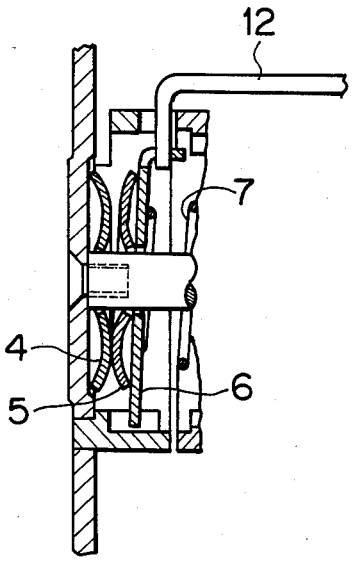
FIG. 5 is a vertical sectional view of the device of the invention in an operative condition.

The thread tension dial 9 is formed with a thread at an inner side thereof, and the adjusting member 8 is in engagement with said thread. A rod 12 has a bent portion inserted into a slot of the actuating plate 6 as shown in FIG. 3. The other end of rod 12 is operatively connected to the lever 40.

Discs 4 and 5 are loosely mounted on shaft 2 and can be moved axially.

The actuating plate 6 is also mounted on shaft 2 so as to axially move relative thereto. The actuating plate 6 has an opening 6C which receives a bent end 12A of rod 12 the other end of which is operatively connected to the fabric presser lifting lever 40.

The tension adjusting member 8 can be also freely moved on shaft 2 in the axial direction. The tension adjusting member 8 is prevented from rotation by means of a pin 11 implanted on the shaft 2. The tapered coil spring 7 is wound around the shaft between the tension adjusting member 8 and the actuating plate 6.

The operating cylinder dial 9 is rotatably mounted on the shaft 2 and is coaxial with the tension adjusting member 8. The operating dial 9 has a threaded inner periphery which is in engagement with the threaded outer periphery of the tension adjusting member 8.

The thread tension of FIGS. 1–4 is operated as follows:

When dial 9 is rotated in one direction, the tension adjusting member 8 is moved in the leftward direction in FIG. 3 along the shaft 2 due to the threaded engagement between the dial 9 and the member 8. As the screw of member 8 is moved in this direction, the tapered coil spring 7 is compressed between the member 8 and the actuating plate 6. As a result, the substantially vertically oriented actuating plate 6 is moved in the leftward direction and presses the peripheral curved face of the thread tensioning disk 5, so as to press the pair of thread tensioning disks 4, 5 against the mount plate 1. Thus the degree of pressure between the two thread clamping faces 4B, 5B of the respective disks 4, 5 is variably determined in dependence upon the degree to which the dial 9 is rotated in the one direction. On the other hand, if the dial 9 is rotated in the opposite direction, the tension adjusting member 8 is moved in the rightward direction in FIG. 3, and accordingly the tapered coil spring 7 is elastically expanded to reduce pressure between the two thread clamping faces 4B, 5B of the thread tensioning disks 4, 5 until the pressure becomes 0.

Thus, the thread tension is adjusted by rotation of the thread tension dial 9. If the adjusting member 8 is checked from rotation by the rotation pin or stopper 11 and if the thread tension dial 9 is rotated, this rotation will be translated into a movement in a thrust direction due to a screwing action. The force of the thread tension spring is adjusted by its expansion and compression, and the adjusted force is transmitted to the thread tension discs 4, 5. When the pressure lever 40 is operated, the disc actuating plate 6 is moved away from the thread tension discs 4, 5 by means of the rod 12 moved in cooperation with the presser lever 40. However, since plate 6 contacts the outer circumferential edges of the thread tension disc 5 the plate 6 departs from said substantially vertical orientation and becomes inclined together with the disc 5 around a fulcrum of a curved part at an opposite side of the disc 5, due to the action of the spring 7 and the curved faces of the thread tension discs, so that a space is made between the thread tension discs 4 and 5. At this time, the other thread tension disc 4 is pressed toward the base plate 1 at a fulcrum of the inclined thread tension disc 5, and is closely contacted there.

Figure 8:
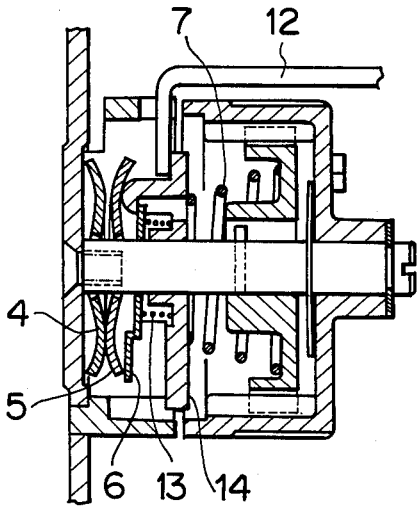
FIG. 8 is a sectional view of the deivce of FIG. 6 in an operative condition.
Figure 6:
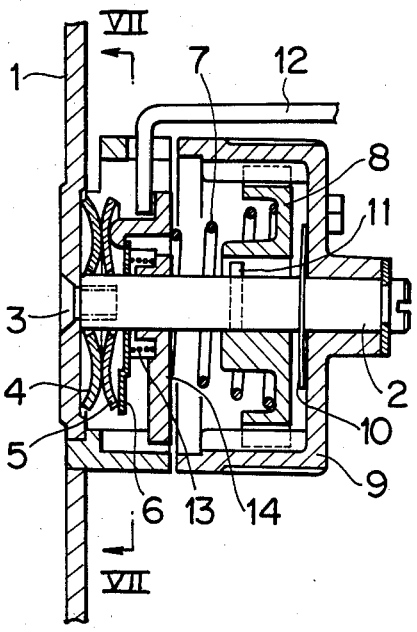
FIG. 6 is a sectional view of a second embodiment of the invention.
Figure 7:
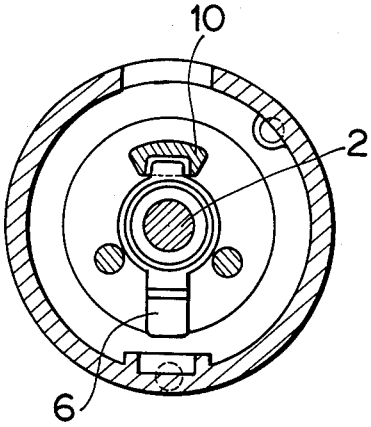
FIG. 7 is a sectional view taken along the line VII—VII of FIG. 6.
Figure 9:
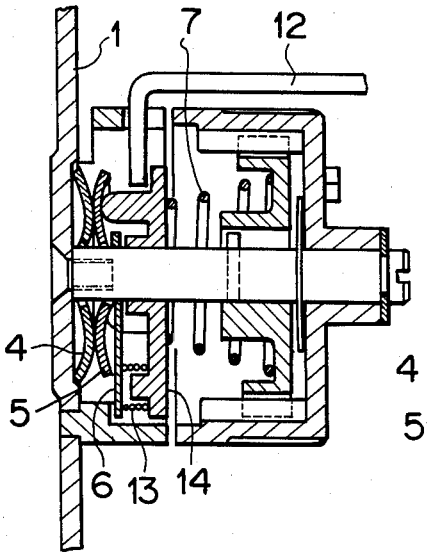
FIG. 9 is a sectional view of a third embodiment of the invention.
Figure 11:
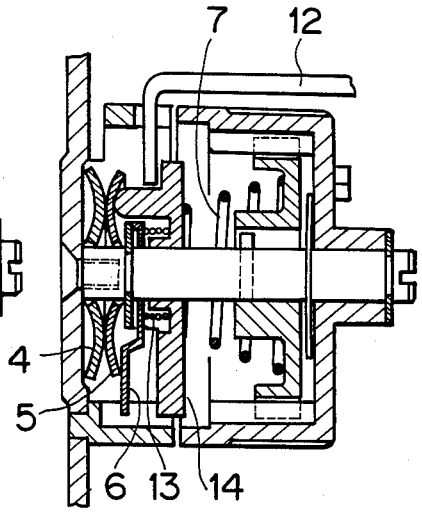
FIG. 11 is a sectional view of a fourth embodiment of the invention.
Figure 10:
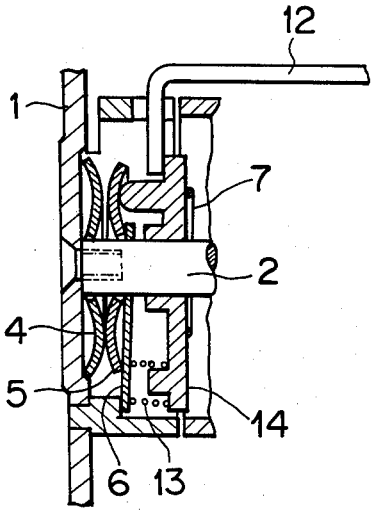
FIG. 10 is a sectional view of the third embodiment of the invention in an operative condition.
Figure 12:
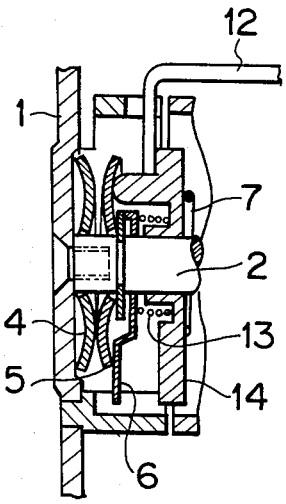
FIG. 12 is a sectional view of the fourth embodiment in an operative condition.

A second embodiment is shown in FIGS. 6 to 8, a third embodiment is shown in FIGS. 9 and 10, and a fourth embodiment is shown in FIGS. 11 and 12. The reference numeral 13 designates a disc actuating spring which exerts pressure onto the disc actuating plate 6, and the numeral 14 designates a spring receiving member which transmits or stops the action of the thread tension spring with respect to the thread tension discs 4 and 5.

The thread tension is adjusted by rotating the thread tension dial 9. Since the adjusting member or acrew 8 is prevented from rotation by the rotation stopper 11, and if the thread tension dial 9 is rotated, this rotation will be translated into a movement exerting in a thrust direction, and the force of the thread tension spring will be trasmitted to the thread tension discs 4, 5 via the spring receiving member 14. When the presser lever 40 is operated, the spring receiving member 14 is moved in opposition to the thread tension discs 4, 5 by means of the thread loosening rod 12 in cooperation with the presser lever, 40 to thereby provide a condition for stopping the action of the force of the thread tension spring 7 on the thread tension discs 4, 5 so that the thread is loosened. At this time, the disc actuating plate 6 contacts the outer circumferential parts of the thread tension discs 4, 5 and the spring receiving member 14. Since the force of the spring 13 acts at these two points, the thread tension disc 5 becomes inclined together with the disc actuating plate 6 at a fulcrum of the curved part thereof, and a space is made at a position opposite to the fulcrum. The other thread tension disc 4 is pressed toward the base plate 1 at the fulcrum of the inclined thread tension disc. closely contacts the plate. The force of the disc actuating spring 13 is so weak that the thread tension disc 5 becomes inclined when the thread is loosened. If the contacting point of the disc actuating plate 6 and the thread tension disc 5 where outside of the curved part of the thread tension disc 4, a destined function would be obtained with structures as shown in FIGS. 9 and 11.

As mentioned above, in the invention, the space can be exactly formed between the thread tension discs when the presser lever 40 is operated in order to reduce the resistance at setting the thread, so that the machine operator may deal with the thread with one hand. Although the thread tension discs. are made so that the pressure on the thread tension discs is released, the thread tension discs at the side of the thread tension base plate contact the thread tension base plate, so that an erroneous space or unnecessary part can be avoided. One thread tension disc is inclined toward the other disc at the side of the thread tension base plate, and therefore the space is made at the entrance of the thread but the thread tension discs are contacted at the thread discharge, and they hold the thread therebetween during the stitching operation, so that the thread may be prevented from flying out of the discs due to twisting or distortions caused by pulling the thread.

It will be understood that each of the elements described above, or two or more together, may also find a useful application in other types of upper thread tension devices differing from the types described above.

While the invention has been illustrated and described as embodied in an upper thread tension device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A thread tension device of a sewing machine having a fabric presser bar, and a fabric presser bar lifting lever operatively connected to the fabric presser bar and operated in one way to shift the fabric presser bar away from a fabric to be sewn and in another way to shift the fabric presser bar toward the fabric, said thread tension device comprising a mount plate fixedly arranged in the sewing machine; a support shaft having one end secured to said mount plate; thread tensioning means including a pair of thread tensioning disks coaxially mounted on said support shaft and having concentrically arranged curved thread clamping faces adapted to be pressed against each other to clamp therebetween an upper thread of the sewing machine; spring means progressively operated with respect to said pair of thread tensioning disks to adjustably press said disks against said mount plate; thread tension adjusting means operated to progressively increase or decrease, respectively, an elastic force of said spring means to thereby adjust a thread clamping pressure between the thread clamping faces of said thread tensioning disks; a substantially vertical oriented actuating means provided between said spring means and said pair of thread tensioning disks to press one of said thread tensioning disks against said mount plate and press the other of said thread tensioning disks against said one thread tensioning disk; and transmission means including a transmission rod having one end operatively connected to said actuating means and other end operatively connected to said fabric presser bar lifting lever, said transmission rod being operated by the fabric presser bar lifting lever when the latter is operated in said one way so as to actuate said actuating means to depart from said substantially vertical orientation to thereby turn said other thread tensioning disk axially of said support shaft on a fulcrum provided by an end portion of said curved thread clamping face of said other thread tensioning disk, so as to move a diametrically opposite end portion of said thread clamping face of said other thread tensioning disk away from said one thread tensioning disk.

2. The thread tension device as defined in claim 1, wherein said actuating means includes an actuating plate having one end operatively connected to said one end of said transmission rod, and said spring means includes a coil spring connecting said actuating plate and said other of said thread tensioning disks such that said actuating plate and said other thread tensioning disk may be operated as a single unit.

* * * * *